US006236372B1

(12) United States Patent
Lindenmeier et al.

(10) Patent No.: US 6,236,372 B1
(45) Date of Patent: May 22, 2001

(54) ANTENNA FOR RADIO AND TELEVISION RECEPTION IN MOTOR VEHICLES

(75) Inventors: Heinz Lindenmeier, Planegg; Jochen Hopf, Haar; Leopold Reiter, Gilching; Rainer Kronberger, Höhenkirchen, all of (DE)

(73) Assignee: Fuba Automotive GmbH, Bad Salzdetfurth (DE)

( * ) Notice: Subject to any disclaimer, the term of this patent is extended or adjusted under 35 U.S.C. 154(b) by 0 days.

(21) Appl. No.: 09/046,226

(22) Filed: Mar. 23, 1998

(30) Foreign Application Priority Data

Mar. 22, 1997 (DE) ..... 197 12 197

(51) Int. Cl.[7] ..... H01Q 1/32
(52) U.S. Cl. ..... 343/713; 343/704
(58) Field of Search ..... 343/704, 713, 343/725, 860, 861, 876

(56) References Cited

U.S. PATENT DOCUMENTS

| | | | | |
|---|---|---|---|---|
| 4,439,771 | * | 3/1984 | Kume et al. | 343/704 |
| 4,791,426 | * | 12/1988 | Lindenmeier et al. | 343/713 |
| 4,823,140 | * | 4/1989 | Shibata et al. | 343/713 |
| 4,864,316 | * | 9/1989 | Kaoru et al. | 343/713 |
| 4,914,446 | | 4/1990 | Lindenmeier et al. | 343/704 |
| 5,581,264 | * | 12/1996 | Tabata et al. | 343/713 |

FOREIGN PATENT DOCUMENTS

| | | | | |
|---|---|---|---|---|
| 3619704A1 | | 6/1986 | (DE) . | |
| 3618452A1 | | 12/1987 | (DE) . | |
| 3719692A1 | | 12/1988 | (DE) . | |
| 3914424C2 | | 2/1992 | (DE) . | |
| 0269723B1 | | 6/1987 | (EP) . | |
| 0188103 | * | 11/1982 | (JP) | 343/713 |

OTHER PUBLICATIONS

No. 03220825, In: "Patent Abstracts of Japan", Publ. Sep. 30, 1991 Appl. No. 02016793, Toopta Motor Corp., Inventor: Masafumi.

No. 06013951, In: "Patent Abstracts of Japan", Publ. Jan. 21, 1994 Appl. No. 04168674, Nippon Tel. , Inventor: Yasushi.

No. 53027348, In: "Patent Abstracts of Japan", Publ: Mar. 14, 1978 Appl. No: 51102355, Mitsubishi, Inventor: Tadashi.

* cited by examiner

*Primary Examiner*—Don Wong
*Assistant Examiner*—Tan Ho
(74) *Attorney, Agent, or Firm*—Collard & Roe, P.C.

(57) ABSTRACT

An antenna installation for radio and television reception in motor vehicles in the meter and decimeter frequency wave ranges with a first antenna and-at least one additional antenna on the vehicle. The receiving signal available at each connection point of the antennas are combined in a collecting network. The signal then flows out of the collecting network to a reception point to form an overall receiving signal. The line and collecting network is designed to select the highest possible reception quality for a motor vehicle moving through a reception field based upon a statistical average.

22 Claims, 13 Drawing Sheets

ANTENNA FOR RADIO AND TELEVISION RECEPTION IN MOTOR VEHICLES

BACKGROUND OF THE INVENTION

The invention relates to a television and radio antenna in motor vehicles in the meter (high) and decimeter (very high) frequency ranges. The invention is based on a multi-antenna system for creating an antenna diversity system.

The Prior Art

Radio and Television multi-antenna systems are described, for example in European Patent EP 0 269 723; German Patents DE 36 18 452; DE 39 14 424; DE 37 19 692; P 36 19 704; and may employ different types of antennas such as a rod, windshield, windowpane or similar antennas. One problem with these patents is that with an adequate HF-decoupling of the antennas, reception interferences occur in the receiving field when the vehicle moves into different positions. Such reception interferences occur in connection with transient drops in the reception level because of multi-path propagation of the electromagnetic waves. This effect is explained by way of example in EP 0 269 723 with the help of FIGS. 3 and 4.

To overcome these problems, a scanning antenna diversity system is used to switch from one antenna to another when a reception interference occurs in the operating antenna. These diversity antennas provide an additional antenna to keep the number of level drops or signal breaks leading to reception interferences in a predetermined receiving field as low as possible on the receiver input. Diversity antennas are extensively effective, but require an indicator for the interference taking place, equipment for changing over the antennas, as well as two antennas. Unfortunately, the interference indicator and the required change-over equipment can be quite expensive. On the other hand, it is desirable to raise the receiving quality as high as possible, especially when an antenna diversity system is employed.

When trying to overcome these breaks in reception, statistical modeling by Rayleigh has been used to map the signal paths of radio and television waves. From these statistical models of the electromagnetic waves incident on the vehicle, it is known that locally limited level breaks of the receiving signal occur with each antenna present on the vehicle. When driving, these level breaks cause short-term reception interferences which are perceived as extremely annoying when receiving with only one antenna.

SUMMARY OF THE INVENTION

Therefore, it is an object of the invention is to obtain the highest possible receiving quality for a car antenna.

Another object of the invention is to provide a diversity antenna system that is simple in design, easy to operate and install.

Essentially, the invention relates to a diversity antenna that receives electromagnetic waves from a radio or television station from all azimuthal space directions with a similar probability especially in urban areas and hilly and mountainous regions. Therefore, the plot of the reception level of each of the antennas during a drive over time is practically independent of the shape of the relative azimuthal directional diagram. In addition, because the individual antennas have different directional diagrams, different positions, and different designs, breaks or drops in the receiving level of the individual antennas do not occur simultaneously.

Therefore, since the present antenna provides inconsistent drops in reception, it can provide consistent readings for reception. Accordingly, the probability curves for the antennas exceeding their threshold level are practically overlapping. However, there is a slight shift in these curves which is caused by a difference between the mean-time values of the logarithmic receiving levels of two antennas ($S_{meddb2}-S_{meddb1}$). The sensitivity of the receiving installation is measured based on its inherent noise, and the actual signal/noise (S/N) spacing (or separation). This spacing is determined by the ratio of the effective value of the useful level received on the antenna output to the effective value of the inherent noise level of the receiving installation based on the receiver input. For interference-free reception, the antenna may be required to exceed a defined minimum value $SNR_{min}$. The probability "p" for falling short of this value when driving in a region with a mean or median value $S_{med}$ of the receiving level, and a noise level N, with a median value $S_{med}/N$ resulting therefrom, can be stated as follows:

$$p=1-\exp\left(-SNR^2_{min}/(S_{med}/N)^2\right) \quad (1)$$

Both of these values are expressed as usual in the logarithmic measure of dB, which is obtained by the following formula:

$$SNR_{mindB}=20^*\log(SNR_{min}) \text{ and } (S_{med}/N)_{db}=20^*\log(S_{med}/N) \quad (2)$$

The probability "p" for falling short of the minimum requirement $SNR_{min}$ in dB when driving through a region or area the following is obtained from the following formula:

$$p=1-\exp\left(-10^{(SNRmin_{db}-Smed/N)_{db})10}\right) \quad (3)$$

This probability for the occurrence of interference occurs when the transmitted signal falls short of the minimally required signal/noise ratio. In this case, the probability of interference is synonymous with the relative interference time, with the proviso that the interference time is measured in percent of p%=p*100.

In the past, reception quality or Q was measured based upon the probability of interference by the following formula:

$$Q=1/p \quad (4)$$

$Q_{dB}'$ can be precisely expressed also by the logarithmic measure with $$Q_{db}=-20^*\log\left[1-\exp\left(-10^{(SNRmin_{db}-Smed/N)_{db})10}\right)\right] \quad (5)$$

This logarithmic value for signal quality is shown in FIG. 1*c* with a completely statistical wave field according to Rayleigh. While the signal quality is independent of the form or shape of the directional diagram of the antenna. In practical applications of the antenna, there is only a minor deviation from this natural law.

For example, in rod-type and windowpane antennas, there is practically no deviation from the above conformity to natural law. In practical life, especially the typical "indent" of the azimuthal directional diagram over an angle range of up to 30° as it is frequently found with antennas, has hardly any notable negative effect because of the Rayliegh wave field. However, there have been recent efforts to obtain omnidirectional azimuth diagrams even though this criterion is not suitable for evaluating the receiving quality. For example, U.S. Pat. No. 4,260,989 is cited here as an example of such efforts, where azimuthal directional diagrams are shown in FIGS. 28*a* to 29*e* without notable "fading", which are obtainable with the bizarre antenna structures specified in said reference.

However, because of the Rayleigh wave distribution, level breaks, fading or indents occur when driving with these antennas because they cancel the incident waves in various locations and lead to level indents when all of these waves are evaluated with a round azimuthal diagram. This shows that the demand or call for a diagram without indents is of little help. It has been shown that such a demand opposes optimization of the receiving quality as described above, especially when antennas are designed for a complete (overall) radio frequency range. The possibility for optimization is inadmissibly narrowed down by such a demand.

Therefore, contrary to the opinion frequent heard, which is that azimuthal roundness of the antenna diagram is the only important antenna property for VHF radio reception, the fact is that the expression $$(S_{med}/S_{min})_{dB}=(S_{med}/N)_{dB}-SNR_{mindB}, \quad (6)$$

which inserted in equation 5 for the receiving quality results in $$Q_{dB}=-20^{*}\log\left[1-\exp(-10^{-(Smed/Smin)dB/10})\right]$$

which represents the decisive or relevant feature for the receiving quality where $S_{min}$ is the minimum value of the signal level required in order to satisfy the requirement of a defined value for the signal/interference ratio $SNR_{mindB}$. The connection or relation between receiving quality $Q_{db}$ and the mean value of the logarithmic protective signal spacing (separation) $(S_{med}/S_{min})_{dd}$ is plotted in FIG. 1*c*, and shows that in areas with a signal quality $Q_{dB}$ worthy of reception, such quality rises with an increase of $(S_{med}/S_{min})_{dB}$ by twice the value of such growth.

Assuming that an inherent noise level N is obtained in the receiving system with the passively designed part of a receiving antenna (regardless of whether the antenna is designed passive or active with an integrated amplifier), then the optimal passive antenna structure is the one which supplies, in a reception area, the highest possible value of $(S_{med}/S_{min})_{dB}$. This means that the available mean value of the receiving performance of an antenna structure should be as high as possible in a reception area with Rayleigh distribution. The optimization criterion assures that the reception is optimal in all urbane areas and also in the hilly countryside.

According to the invention, a method is introduced for finding an antenna installation on the vehicle which is optimally formed by a plurality of antennas. The signal quality that is to be expected with radio reception with one antenna can be determined as compared to a reference antenna—such as, for example, the known rod antenna based on the difference of the mean logarithmic values of the available receiving levels ($S_{meddB}$) of both antennas between the values for all azimuthal angles of incidence. This value can be acquired in a particularly effective way by comparative, computer-supported measurements on the antennas mounted on the vehicle, whereby the vehicle is turned on a rotary stand in defined and sufficiently small angular steps against the direction of incidence of a defined wave.

Value $S_{meddB}$ (for example in dB$\mu$V) of the vehicle rotated around the entire azimuth range of 360 degrees, being averaged across all azimuthal angle values, permits with the help of the curve shown in FIG. 1*c*, an estimation of the differences in the reception quality of the vehicle moving along normal traffic routes. It has been found in practical tests that a Rayleigh field distribution develops within the surroundings of the vehicle, due to refraction and reflection on natural unevenness of the terrain or on installed equipment. The Rayleigh field distribution looks at a median value $S_{meddB}$ as a value relevant to the evaluation of the antenna performance. Disregarding a few exceptions of a completely flat terrain with a naturally low traffic volume far away from urbane areas, an antenna with an optimized $S_{meddB}$ value thus basically supplies the best possible reception for all users even if the azimuthal directional diagram has deep but not excessively wide "indents" or fading.

This calculation method makes it possible to determine the phase and amplitude values of the phase and amplitude evaluation members in an extremely short time. These measurements are carved out with the help of computer-controlled and rapidly working measuring equipment in association with a calculus of variations carried out in the computer. In addition, the phase and amplitude values can also be determined empirically with the help of measurement drives in a reception field with statistically incident and superimposed partial waves. However, because these measurements take time and they are unreliable, this method is hardly feasible.

Instead, a measurement drive of this type can be simulated just as well by calculating a reception field formed by partial waves. These partial waves are incident from all azimuthal directions with statistically selected amplitudes and are superimposed on each other. Depending on where the vehicle receives the signals in these wave fields, the partial waves lead to contributions conforming to the complex directional characteristics of the individual antennas. These phase and amplitude values of the phase elements and amplitude evaluation elements, which superimpose on each other at the collecting connection point. Based on the amount and phase of these waves, they form the receiving signal. The median value of the reception levels can then be optimized through calculation with the help of an adjustment of the phase and amplitude values carried out in the computer. Since there is a sufficiently large number of incident partial waves, and through the uniform azimuthal distribution of these waves, the optimization of the median value leads to the same result as optimization of median values based on the evaluation of the azimuthal $S_{meddB}$ directional diagrams. Therefore, to optimize the reception behavior in a Rayleigh wave field, it is sufficient to optimize the antenna through a variation of the phase and amplitude values of the phase and amplitude evaluation elements. This optimization is due to the of median value $S_{meddB}$ at the collecting connection point. The measurement of the median value results from the evaluation of the azimuthal directional diagram.

Measurements of the complex scatter parameters of the transmission distance (from the emitting antenna to the test antenna) for all azimuthal angle values serve as the basis for optimizing the receiving quality of an antenna. The antenna connection (or wiring) points 4 are viewed for these measurements as connection gates within the meaning of the theory of electric circuits. The complex overall matrix of these gates is determined by describing the relations between the electric quantities on the connection gates, to which a line and a collecting network with a connection point are later connected. Furthermore, excitation in the case of reception is detected by a substantially horizontally incident wave for all azimuthal angles based on the amount and phase relative to each other. The parameters of the matrix containing the remotely disposed emitting antenna are known in this way for all azimuthal angles and used for describing the electric quantities on connection gates based on the incident wave.

The measurement technology usually employed for detecting scatter parameters was found to be particularly advantageous for describing the electric characteristics, especially due to the availability of such measuring systems. It is possible with the help of such parameters, to combine the received signals of the individual antennas in an overall receiving signal via an arithmetically applied line and collecting network with phase and amplitude evaluation elements.

By applying arithmetic methods of optimization such as, the calculus of variations, optimal phase values and amplitude evaluation factors of line and collecting network can be determined based on such methods in view of a maximum value of $(S_{med}/S_{min})_{dB}$ in a short calculation time. Phase elements and amplitude evaluation elements can be realized in the line and collecting network in accordance with known methods of circuitry technology. Optimization can be aimed at different goals or objectives. With narrow-band optimization, the median value $(S_{med}/S_{min})_{dB}$ will be shown arithmetically with respect to all azimuthal rotations, and this value will be optimized by the calculus of the variations. When a predetermined frequency (e.g. VHF-range) is to be optimized, median value $(S_{med}/S_{min})_{dB}$ will be arithmetically shown across all full azimuthal rotations with all possible receive channels, and this value will then be optimized by the calculus of the variations.

BRIEF DESCRIPTION OF THE DRAWINGS other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 1*a* is a diagram of the probability of exceeding the receiving level of two antennas with different median values (SmeddB) of the reception levels.

FIG. 1*b* shows the typical curve of the receiving level of two antennas on a vehicle along a driving route.

FIG. 1*c* shows the relation between receiving quality QdB and the mean value of the protective signal spacing or separation (Smed/Smin) dB;

Figure 4A:
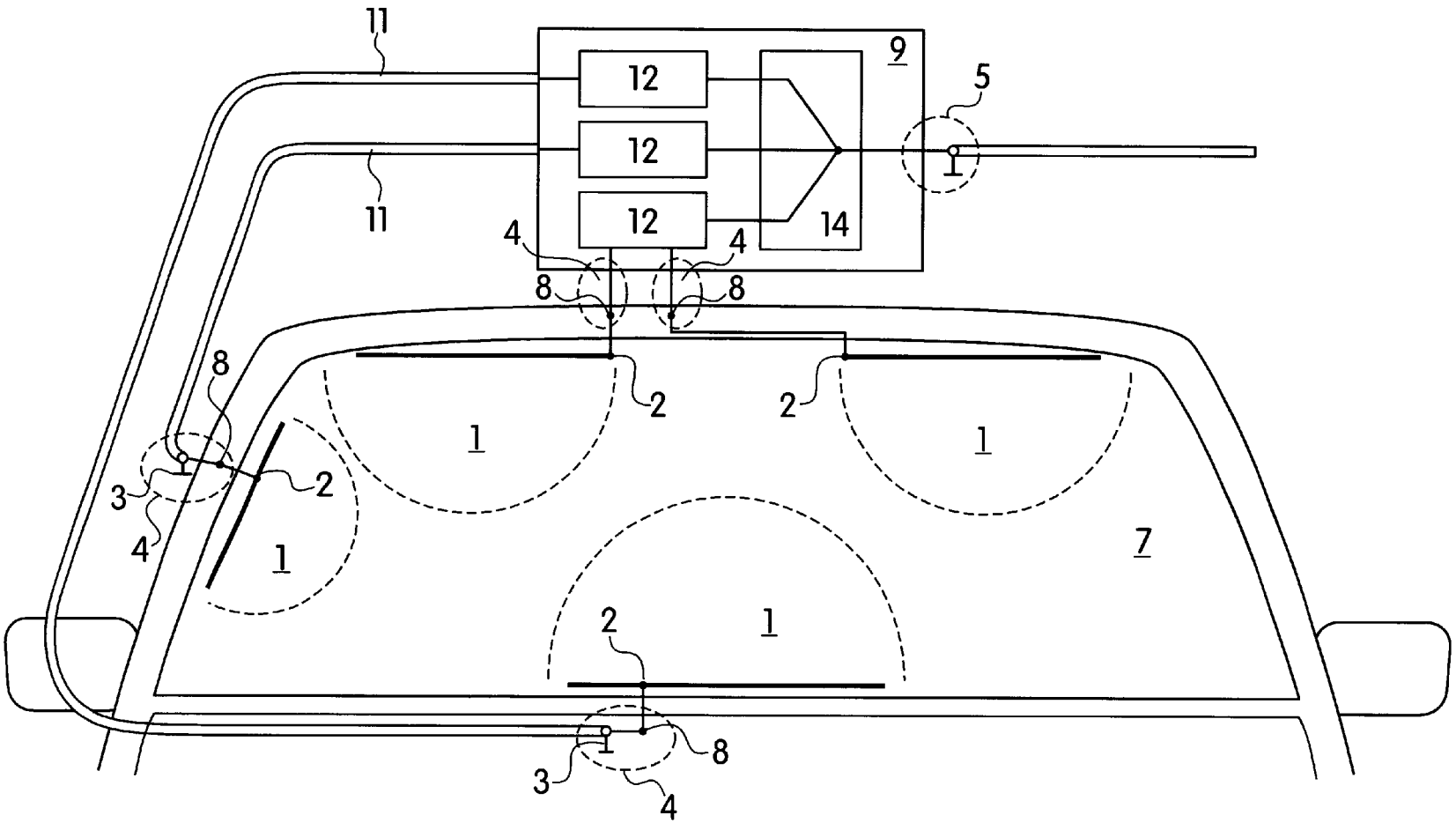
Figure 4B:
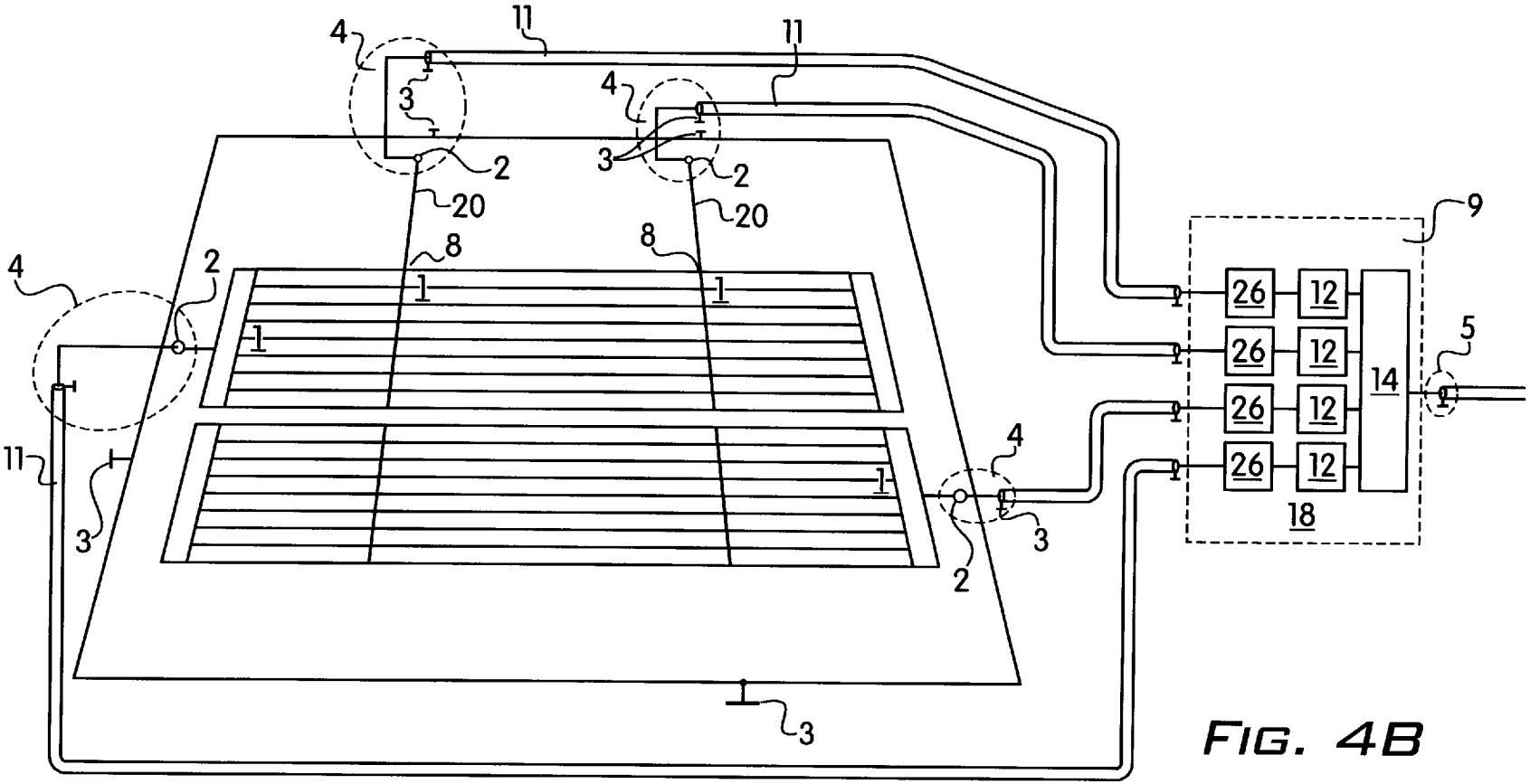
Figure 4C:
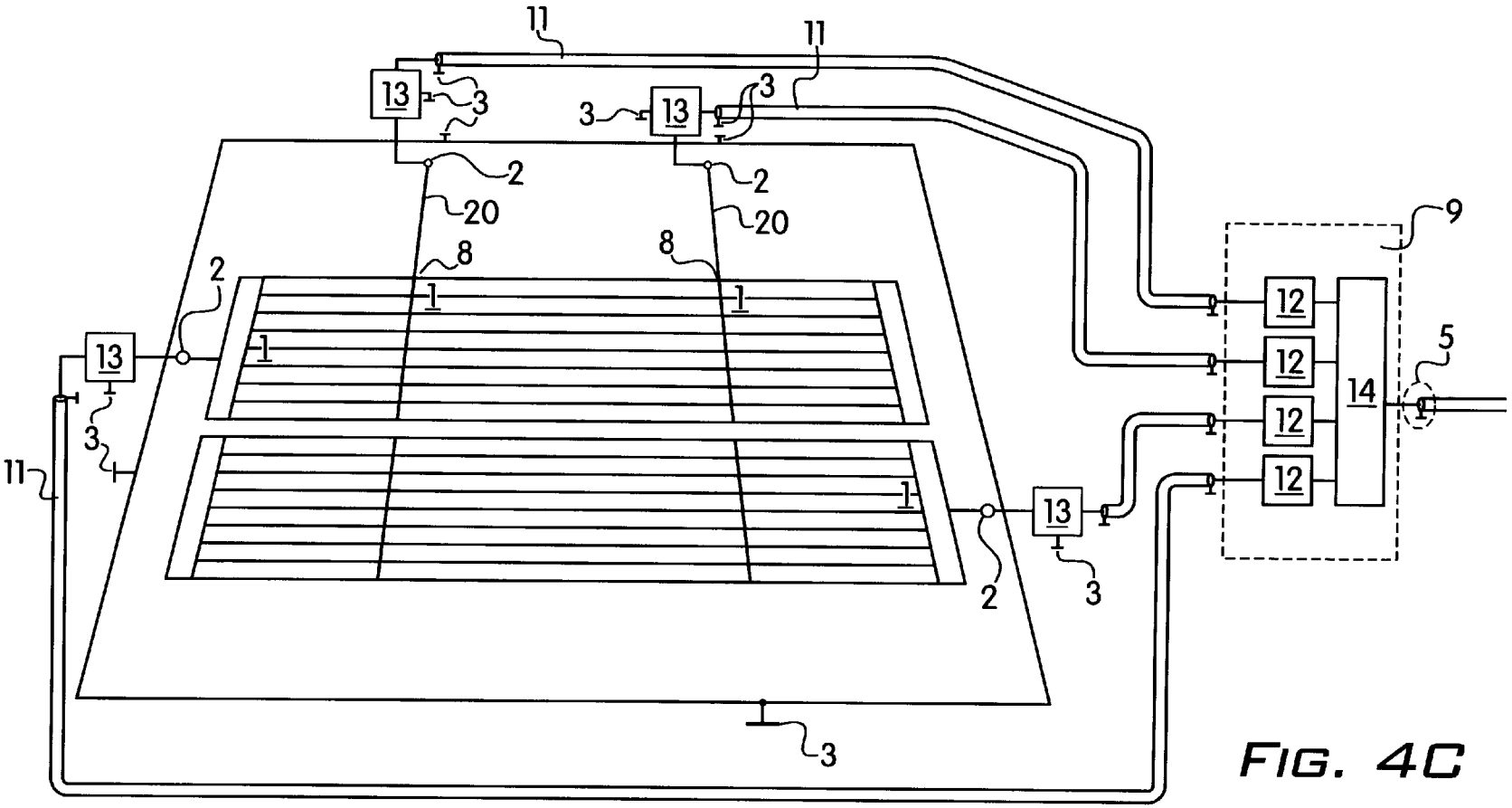
Figure 5A:
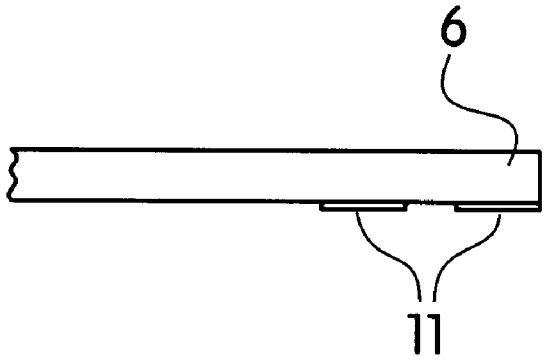
Figure 5B:
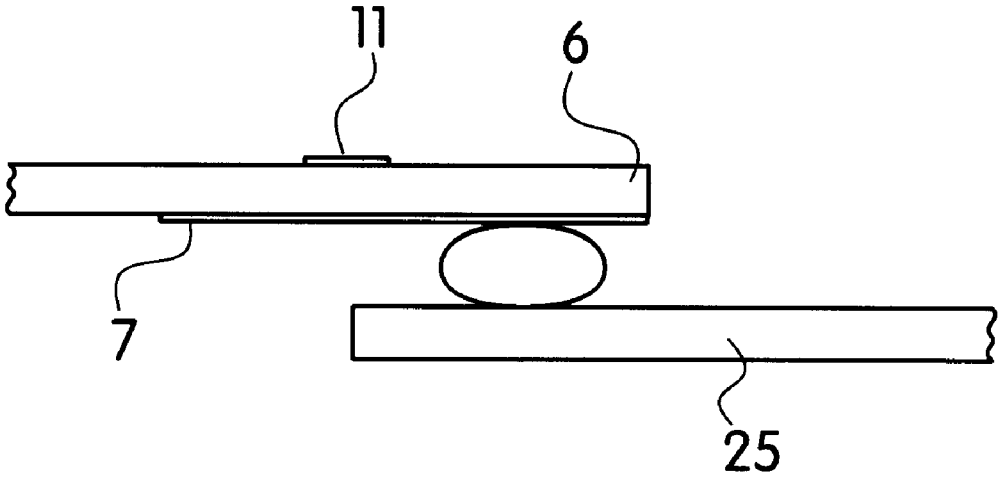
Figure 6:
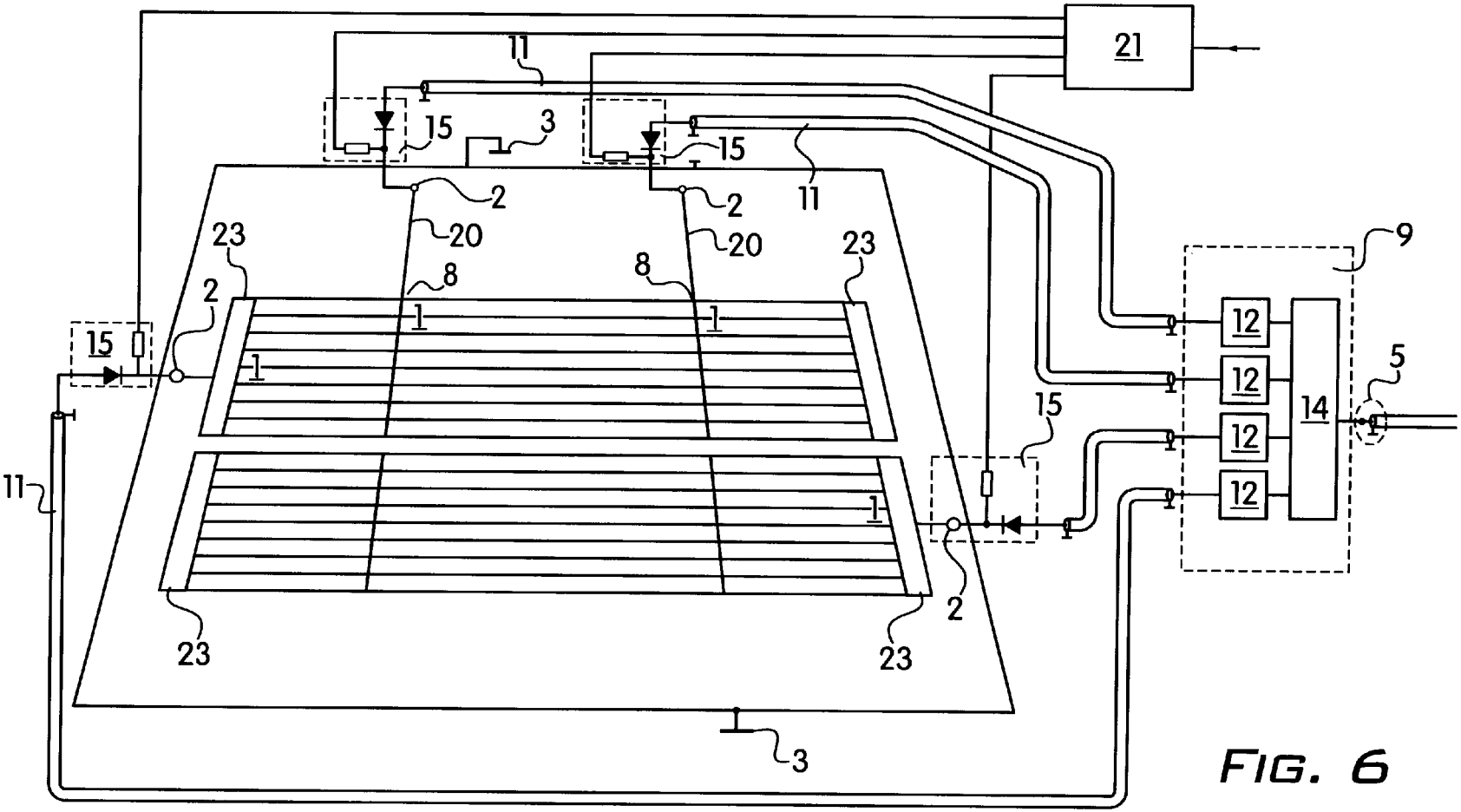
Figure 7:
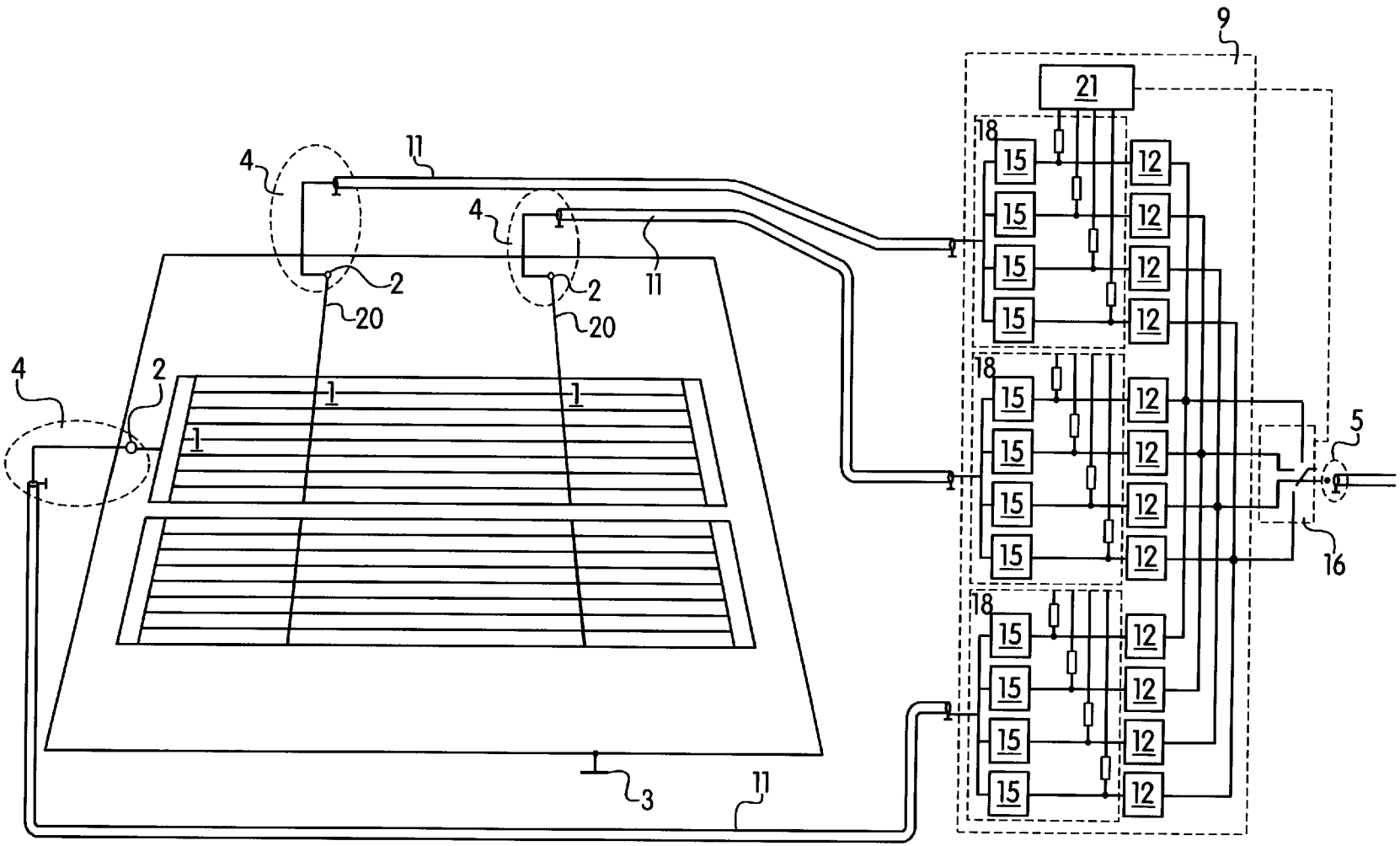
Figure 8:
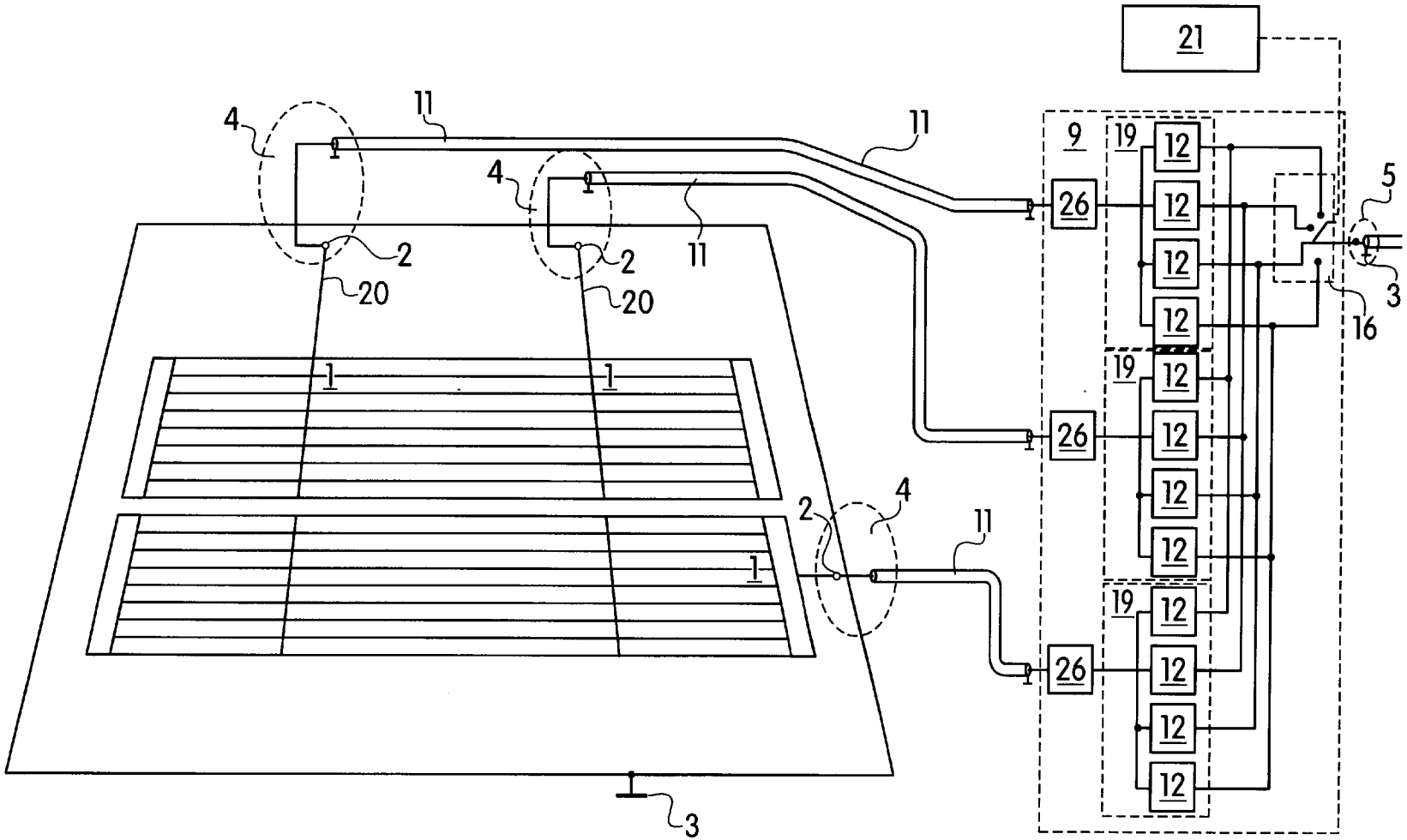
Figure 9A:
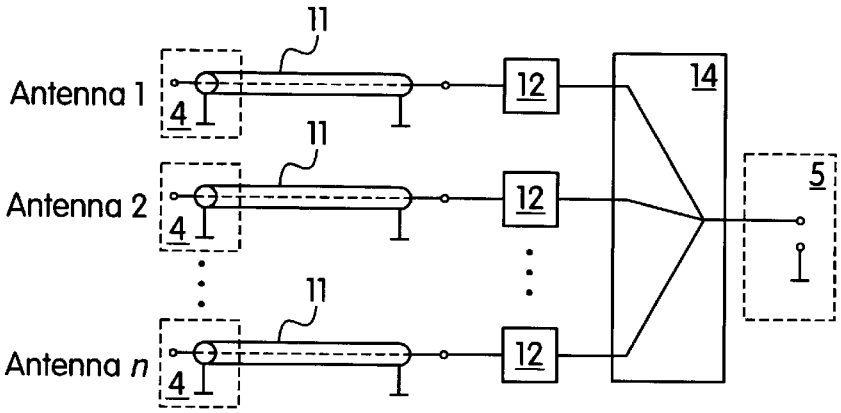
Figure 9B:
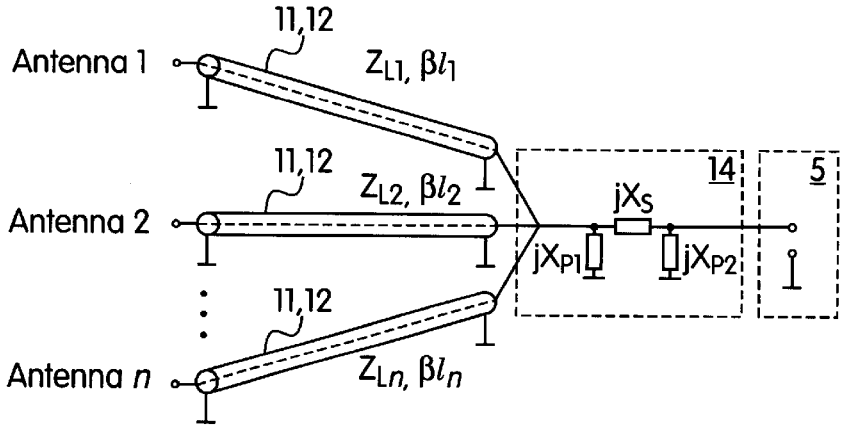
Figure 9C:
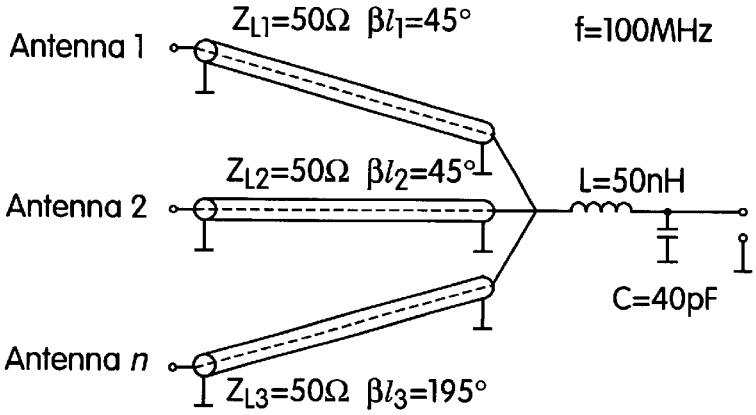
Figure 10:
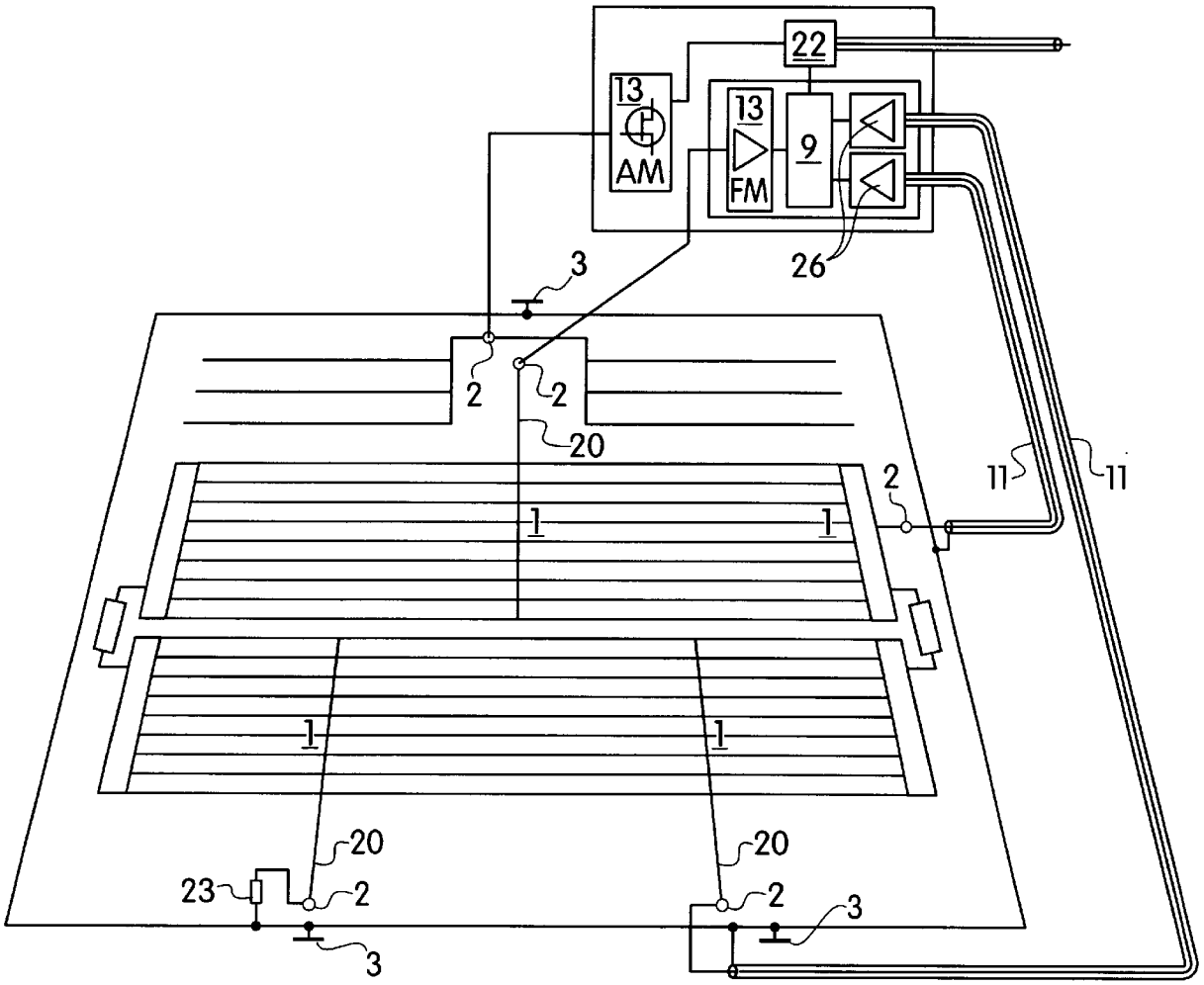

FIG. 4*a* is a diagram of the window antenna installation with a conductive layer applied flat to the window as a conductive area for forming four antennas;

FIG. 4*b* is a diagram of the window antenna installation according to the invention, with wire-like electrical heating conductors installed flat, or printed onto the glass pane;

FIG. 4*c* is a diagram of the windowpane antenna according to FIG. 4*b* with additional low noise antenna amplifier circuits located near the connection points;

FIG. 5*a* shows a coplanar design of a connecting line printed on the window in the marginal zone of the window;

FIG. 5*b* shows a connection line consisting of conductors printed onto opposing surfaces of the glass;

FIG. 6 shows an antenna installation having switching networks installed in the system;

FIG. 7 shows an antenna installation with a multitude phase and amplitude evaluation elements and switching networks;

FIG. 8 shows an antenna installation with a multitude of phase and amplitude evaluation elements connected to amplifiers;

FIG. 9*a* shows a first embodiment of the connection lines, phase and amplitude evaluation elements, and collecting connection points;

FIG. 9*b* shows a second embodiment of connection lines and phase and amplitude evaluation elements;

FIG. 9*c* shows a third embodiment of connection lines and phase and amplitude evaluation elements; and FIG. 10 shows an antenna diversity installation with three antennas for VHF-reception, and one active antenna (AM) for long, medium and shortwave reception.

DETAILED DESCRIPTION OF THE PREFERRED EMBODIMENT

Figure 1A:
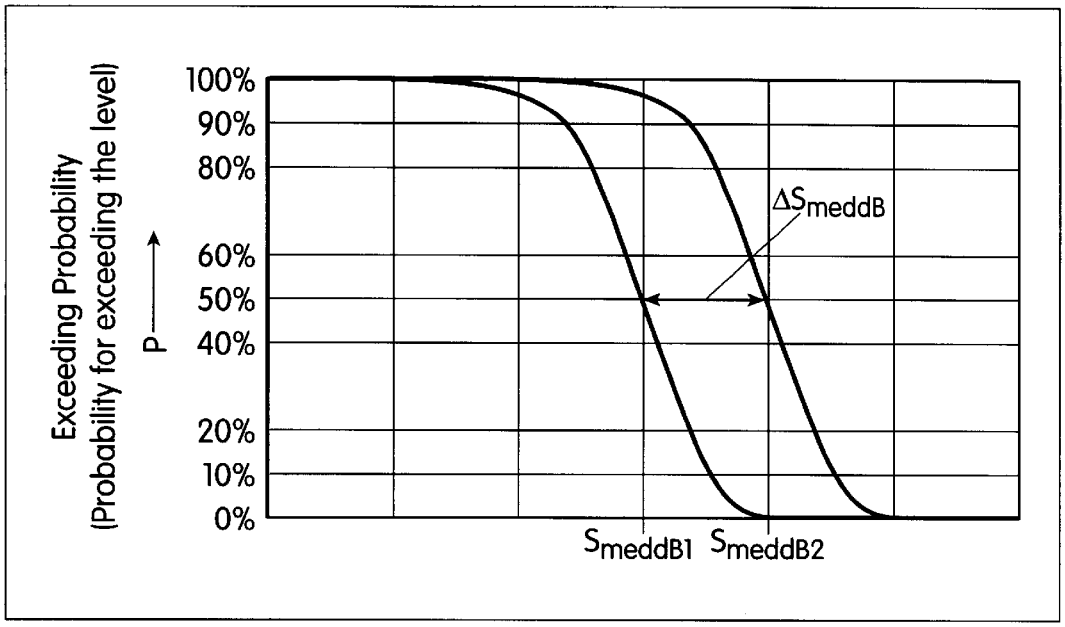
Figure 1B:
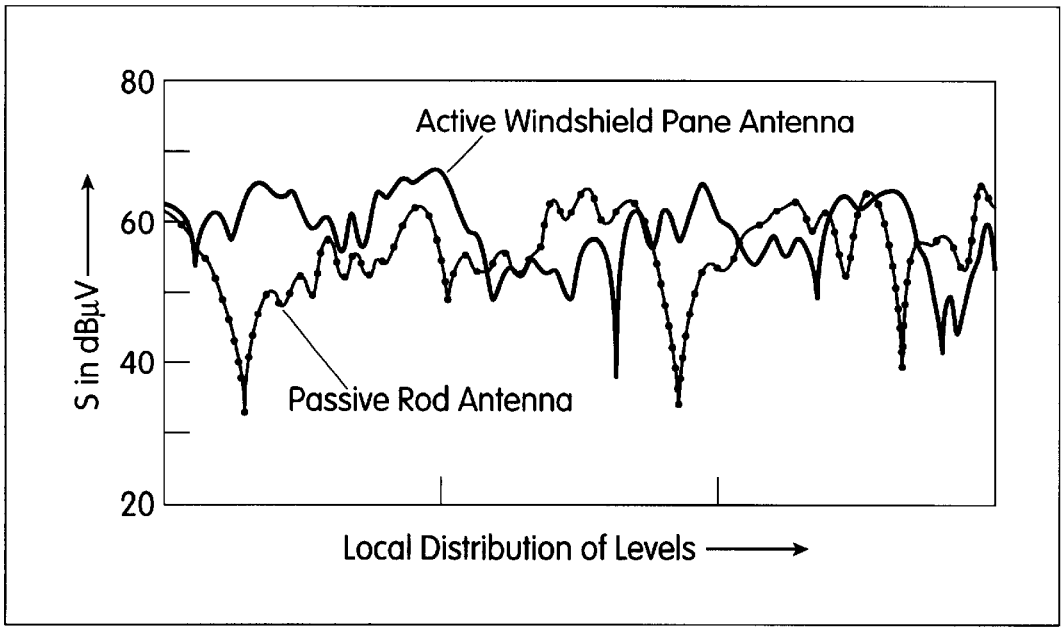
Figure 1C:
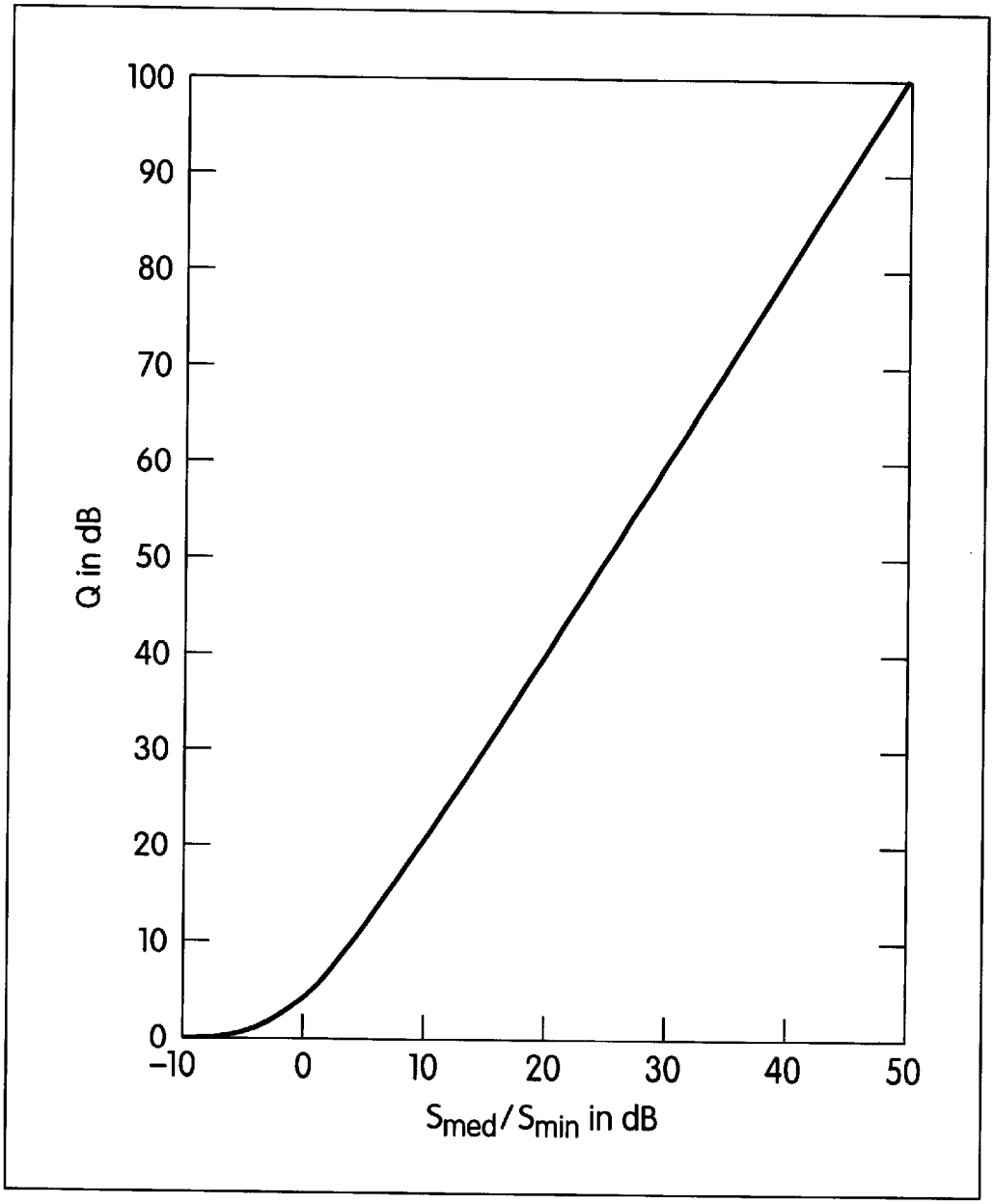

As shown in FIGS 1*a*, 1*b*, and 1*c* antenna according to the invention has one advantage in that the receiving quality averaged over time is always higher, than what can be achieved with each of one of the individual antennas. This advantage can be applied to an antenna installation where no provision is made for any diversity measures.

Using two antennas can be particularly important if no individual antenna is available to supply the required reception quality. By forming a plurality of individual antennas as shown, in FIG. 2, the required reception quality can then be obtained. However, enhancing the reception quality is often desired, even if each of the individual antennas have the receiving quality of known high-quality antennas. This trend is confirmed by the fact that the diversity antenna is frequently applied in practical situations.

For example in FIG., 6, a diversity antenna is employed that has switching off signals that are characterized as switching elements 15, In this case, for example, the individual antennas are combined to form an antenna installation. In addition, the phase elements and amplitude evaluation elements 12 are designed accordingly for conductively wired switching elements 15. In this embodiment of the invention, which requires particularly little expenditure of funds, signals of individual antennas are alternately switched off in situations where the reception contributions amount to zero. Therefore, when one antenna experiences a signal fading or drop in the overall signal, these signals no longer contribute to the overall or total signal, and the fading disappears from the overall signal. Therefore, even when the invention is applied in connection with diversity methods, the overall signal supplies a superior signal quality on the average, based on time, because a better signal quality is obtained as defined by the invention during the static phases of the diversity system.

To obtain the greatest degree of improvement with respect to reception quality, the individual antennas should have different azimuthal directional diagrams, with the greatest possible mean azimuthal gain at low elevations of the incident waves. In addition, if the antennas are installed and separated by at least 1/10 of the operating wave length, then the waves exciting the antennas are effective. However, the antenna should not be too far apart relative to the operating wavelength so as to avoid excessive fanning or spreading out of the azimuthal directional diagram, as measured at the collecting connection point 5. This fanning out would not pose any problem in a complete Rayleigh receiving field with waves incident in very large numbers. However, it may cause interference in flat reception areas where a RICE-distribution with a strong group of waves incident from one angular range is frequently present.

Therefore, to avoid a fanning or spreading out of the waves, it is useful to space the antennas within one wavelength of each other. In addition, as shown in FIG. 2, it is favorable to also include antennas on adjacent windows.

Figure 2:
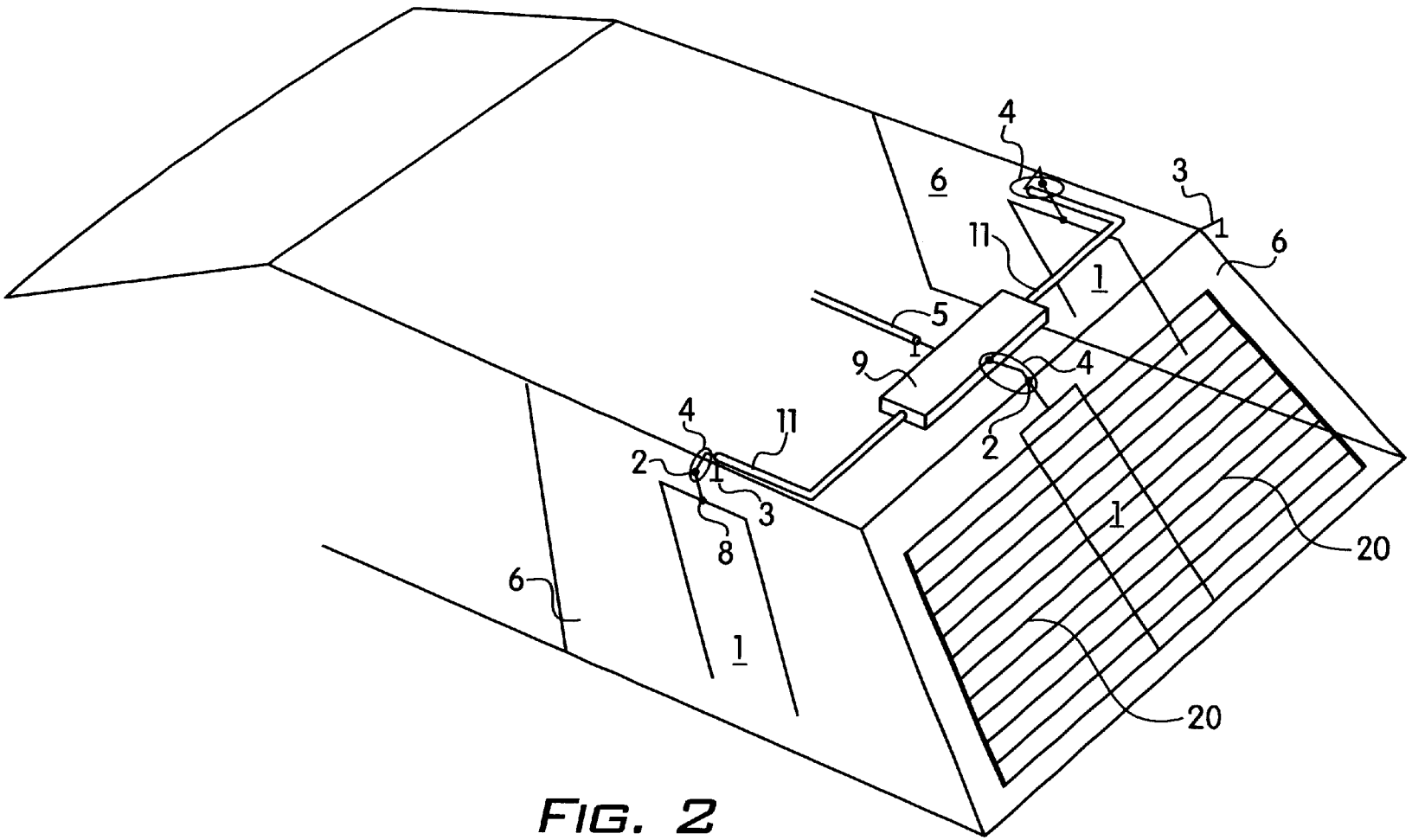
FIG. 2 is a diagram of the the antenna installation with antennas on the rear window, and antennas on the side windows adjacent to the rear window.
Figure 3:
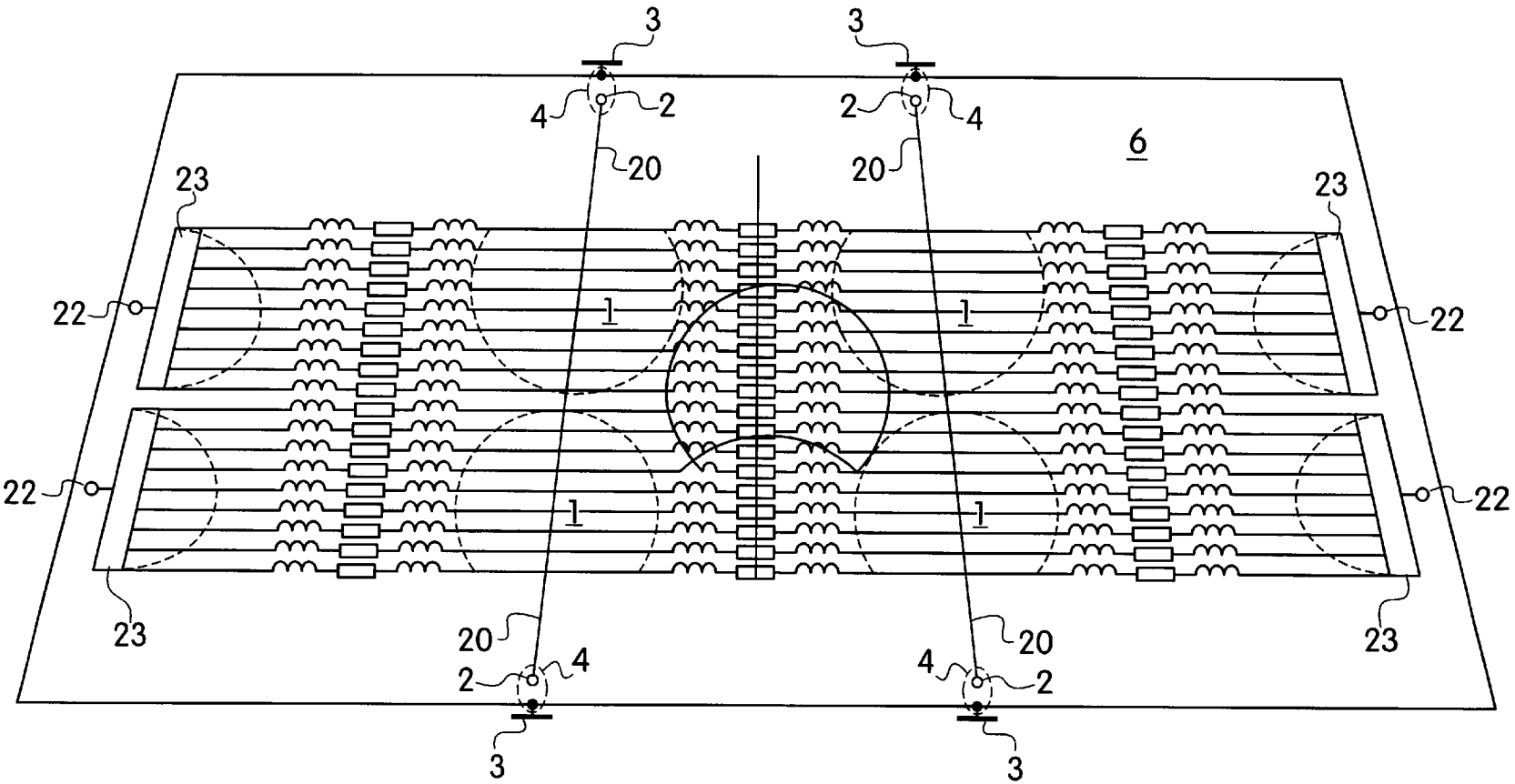
FIG. 3 is a diagram of the window antenna installation with wire-like electrical heating conductors installed flat across the area, or printed onto the glass pane.

FIG. 3 shows an additional embodiment of the invention wherein there is provided a plurality of antennas from a heating field on the rear window. Wire-shaped electrical heating conductors are installed over the area of the glass pane or printed thereon in addition, four antennas 1 with the help of conductors 20 are applied crosswise relative to the heating conductors. The inductive and resistive effects of the heating conductors are shown by inductors and resistors which explain the decoupling mode of operation of the heating conductors. The dashed circle segments qualitatively characterize the regions of the individual antennas 1 acting as capacitive areas. Connection lines 11 FIG. 2, are connected to gates or wiring points 4 as shown for an antenna installation as defined by the invention in FIG. 4*a* or FIG. 4*b*. The received signals, are evaluated via suitably dimensioned phase elements and amplitude evaluation elements 12 which are connected to connection lines 11. These signals are combined in collecting network 9 at connection point 14, and form the overall received signal 10. Signal 10 has an enhanced reception quality and is available at collecting connection point 5.

The antenna arrangement as shown in FIG. 3, whose overall behavior with respect to gates 4 is described by scatter parameters, can be designed as one antenna with collecting connection point 5 in a similar way to antennas 1 in FIG. 2. Gates 4 can be connected to a line and collecting network 9 via connection lines in a manner similar to FIG. 2. In addition, network phase elements and amplitude evaluation elements 12 connect to amplifier circuits 26 which may be contained in collecting network 9 as well. However, the effective relative spacing of antennas 1 from each other should be sufficiently large to prevent interference between the antennas. This spacing ensures that the directional characteristic is influenced by combining the antenna signals at the antenna connection point.

Turning now to FIG. 4*a*, more recently introduced technologies permit a reduction of the infrared transmission of light with the help of extremely thin conductive layers on windowpanes. As shown in FIG. 4*a*, this layer, is represented by area 7 having limited conductivity. With the help of elongated low-resistance electrodes along the covered frame the windowpane, several gates 4 are formed preferably on the upper and lower edges, as well as side edges of the window, with auto body ground points 3 near by. With feed lines 11 leading to line and collection network 9, the antenna signals are combined via phase elements and amplitude evaluation elements 12 at connection point 14. These signals are then available at collecting connection point 5 for further transmission to the receiver. By selecting the phase and amplitude values in elements 12 with the help of the optimization method specified above it is possible to raise the receiving quality of an antenna installation so that it is equal to a rod antenna. The rod antenna may be for example in the VHF-range even though the surface resistance of the thin layer is between 5 and 10 ohms: The shaded semicircles around electrodes 2 in FIG. 4*a* qualitatively characterize the zones associated with each of the electrodes. The behavior of antennas 1 with respect to their gates 4 is determined mainly by these zones.

Referring to FIG. 4*b* there is shown another example of an antenna installation of the invention, in the form of a suitably designed heating field of a rear windowpane with parallel printed heating conductors. Here, the gates 4 are each disposed on the edge of the pane by forming connection points 2. Coupling to the heating field is realized either via the bus-bar, or via conductors mounted transversely to the heating conductors 20. A low-noise line amplifier 26 is interconnected at the end of each connection line 11 on the input of line and collecting network 9. The output signals of these amplifiers are supplied in each case to a phase element and amplitude evaluation element 12. These signals, which are combined via connection point 14, are then available at collecting connection point 5 after the phase and amplitude values with have been optimized with the most favorable signal-noise ratio.

FIG. 4*c* shows another advantageous embodiment of the invention, wherein low-noise antenna amplifier circuits 13 are mounted directly on the gates. By appropriately designing the output impedence of these amplifiers they can be matched to the impedence of connection lines 11. This design makes it possible to largely eliminate the frequency-dependent behavior of these lines, so that-line ampliifier 26 in FIG. 4*b* can be omitted.

Referring to FIGS. 5*a*, and 5*b* there is shown an embodiment of lines 11 for an antenna according to FIG. 4*a*, which can, be realized at particularly favorable cost. The lines comprise printed lines as shown in FIGS. 5*a* and 5*b* extending along the edge of glass pane 6. FIG. 5*a* shows a co-planar embodiment of connection lines 11, whereby the conductor present on the edge is preferably employed as the ground conductor. Connection point 2 can be designed as a capacitive area or surface, which is applied to the opposite surface of the glass and capacitively connected to the voltage-conducting conductor of connection lines 11. In FIG. 5*b*, ground conductor 7 and voltage-conducting conductor 11 face each other on the two sides of glass pane 6.

FIG. 6 shows another embodiment of the antenna for application in a diversity system. Connection points 2 of antennas 1 are connected to line and collecting network 9 via connection lines 11. Collecting network 9 contains switching networks in the form of diodes, which are controlled by diversity processor 21. Phase and amplitude evaluation circuits 12 are optimized so that when all switching networks 15 permit passage, a signal is provided at collecting connection point 5 that satisfies the criteria of the invention. In this switching condition, the overall arrangement acts like an antenna in which the signals on gates 4 largely cancel themselves in the overall signal in case a fading or drop in level occurs. By successively opening one or more, of the switching elements 15, contributions from signals having a fade or drop in level are removed from the signal, so that the break or drop in level disappears. In the position of diversity processor 21, in which switching elements 15 become conductive, the receiver is provided with an enhanced signal. In this case, processor 21 is canceled by the diversity effect in the event a level drop or fading occurs.

Referring to FIG. 7, there is shown a further developed diversity arrangement with antenna installations wherein the output signals from gates 4 are switched by switching elements 15 housed in switching networks 18. With the help of switching networks 18, there are more favorable signals available on an antenna selector switch 16 with the help of the phase elements and amplitude evaluation elements 12 than originally made available by the individual gates 4. It is thus possible for the system to form different directional diagrams with a high azimuthal median value for the diversity operation on the antenna selector switch. Therefore, the selector switch selects the signal least disturbed at the given time and sends it to the collecting connection point 5 with the help of diversity processor 21.

FIG. 8 shows a further developed arrangement of this type, wherein a line amplifier 26 is attached to the end of each connection line 11. The output of amplifier 26 permits a multitude of phase element and amplitude evaluation elements 19, to switch on or off in the system. In this case several signals with directional diagrams with high median values are available again on antenna selector switch 16 thru the connection of the respective phase elements and amplitude evaluation elements 12. These signals are selected by diversity processor 21 on collecting wiring point 5, for further transmission to the receiver.

FIGS. 9*a* 9*b* and 9*c* show embodiments of line and collecting networks 9. For example, FIG. 9*a* shows an arrangement with connection lines 11, coupled to phase and amplitude evaluation circuits 12, and a connection point 14 at which the signals are combined to form the overall signal at collecting connection point 5. The phase shifts conditioned by connection lines 11 naturally have to be taken into account for adjusting the phase and amplitude values in circuits 12.

In FIG. 9*b*, the connection lines 11 and the phase and amplitude evaluation circuits 12 are advantageously designed as lines with suitable wave resistances and electric lengths with connection point 14 downstream and with" impedance matching components Xp1, Xp2 and Xs. FIG. 9*c* shows an example of the arrangement for an antenna system with three antennas.

For additional optimization of the circuit, the gate shown in FIG. 10 at the bottom left can be included in the overall matrix and calculus of variations, and, by loading it with an optimal impedance such as a reactance—it may enhance the reception within the meaning of the invention. Such reactance X is thus part of the line and collecting network 9, which is to be optimized without being actually physically contained in the latter.

Finally, a radio receiving antenna as defined by the invention, with three antennas but without diversity, is shown in FIG. 10. Here, an antenna amplifier 13, two line amplifiers 26, a line and collecting network 9 for forming an antenna for the FM range as well as an AM-amplifier and an AM/FM frequency switch 22, are contained in one network component.

Accordingly, while several embodiments of the present invention have been shown and described, it is to be understood that many changes and modifications may be made thereunto without departing from the spirit and scope of the invention as defined in the appended claims.

What is claimed is:

1. An antenna installation for radio and television reception in motor vehicles in the meter and decimeter wave ranges, comprising:

a first antenna for receiving signals;

at least a second antenna for receiving signals;

a collecting network for receiving signals from said first antenna and said at least a second antenna;

at least one electrical connection line with each line connecting said first antenna and said at least a second antenna to said collecting network said at least one connection line for transmitting the signals received from said antennas;

at least one connection point formed where said at least one connection line contacts said first antenna and said at least a second antenna;

a reception line connected to said collecting network said reception line for transmitting signals received by said collecting network; and a collecting connection point formed by the connection of said reception line to said collecting network wherein the received signals available at each of said at least one connection point of the antennas are combined in an overall receiving signal and the collecting network is designed to select the highest possible reception qualities from said signals based upon a statistical average of the signals in the moving vehicle, and transmit this resultant signal through said collecting connection point to said reception line.

2. The antenna installation according to claim 1, wherein said first and said at least a second antennas are spaced apart from each other by not more than one operating wavelength.

3. The antenna installation according to claim 1, wherein said first and said at least a second antennas are designed as windowpane antennas installed on a windowpane, each antenna further comprising:

an electrically conductive frame surrounding the windowpane;

a ground point forming a HF-reference ground on said frame;

an antenna connection point formed by a connection of said ground point and said at least one connection point;

wherein said first and said at least a second antennas are mounted on the windowpane.

4. The antenna installation according to claim 3, wherein said first antenna and said at least a second antenna are formed by elongated electrical conductors mounted on a glass pane so that at least a unidimensionally conductive area is available, and wherein said installation further comprises a plurality of coupling points located on the edge of the conductive area wherein each coupling point connects said antennas to said connection points via a connection line.

5. The antenna installation according to claim 1 wherein said antennas are designed in the form of rod-shaped antennas, and are mounted either in the front or the rear half of the vehicle.

6. The antenna installation according to claim 1, further comprising a switching network interconnected between at least one connection point and at least one said electrical connection line connected to said connection point, said switching network effecting a switch-off of the respective antenna signal in the presence of a disturbed overall signal, wherein said antenna now forms an antenna diversity system.

7. An antenna installation disposed on a motor vehicle windowpane glass said antenna installation for radio and television reception in the meter and decimeter wave ranges, comprising:

a first antenna for receiving signals;

at least a second antenna for receiving signals;

a collecting network for receiving signals from said first antenna and said at least a second antenna;

at least one electrical connection line with each line connecting said first antenna and said at least a second antenna to said collecting network said connection lines for transmitting the signals received from said antennas;

at least one connection point formed where said at least one connection line contacts said first antenna and said at least a second antenna;

an electrically conductive frame surrounding the windowpane;

a ground point forming a HF-reference ground on the frame;

an antenna connection point formed by the connection of said ground point and said at least one connection point;

a heating field formed by a series of wire-shaped electrical conductors disposed on said windowpane glass wherein said electrical conductors extend substantially perpendicular to said first and said at least a second antenna;

a plurality of coupling points disposed where antennas contact an edge of the heating field wherein said coupling points are formed near the point of contact of the cross conductor and the outermost heating conductor on an edge of the heating field;

a reception line connected to said collecting network said reception line for transmitting signals received by said collecting network; and a collecting connection point formed by the connection of said reception line to said collecting network, wherein the received signals available at each of said connection points of the antennas are combined in an overall receiving signal and the collecting network is designed to select the highest possible reception qualities from said signals based upon a statistical average of the signals in the moving vehicle, and transmit this resultant signal through said collecting connection point to said reception line.

8. The antenna installation according to claim 7, wherein said at least one electrical connection line is installed outside of the field of sight of the windowpane and said at least one electrical connection line has phase-shifting properties that are included in the adjustment of the phase values of said phase-shifting elements.

9. The antenna installation according to claim 8, wherein the impedance of said at least one connection line is selected as close as possible to match the impedance on the conductive frame between said at least one connection point and said adjacent ground point.

10. The antenna installation according to claim 8, further comprising a passive adaptor network interconnected between said antenna connection point and said collecting network, the phase properties of said passive adaptor network being included in the design of the respective phase-shifting element in the collecting network.

11. The antenna installation according to claim 8, wherein said at least one connection line is printed on glass outside of sight of the windowpane along the edge of the windowpane said at least one connection line either in the form of a coplanar line, or mounted on the glass on a non-conductive foil.

12. The antenna installation according to claim 8, wherein said at least one connection line is in the form of a strip line or mounted on the windowpane as a conductor, said connection line being printed outside of the field of sight along the edge of the windowpane on oppositely disposed surfaces of the glass, and further comprising a ground line designed as a conductive area capacitively connected to the conductive window frame.

13. The antenna installation according to claim 12, further comprising a conductive frame printed outside of the field of sight of the window along the edge of the windowpane in the form of a conductive strip, or mounted on the glass.

14. The antenna installation according to claim 12 wherein at least one of said antennas is designed as a rod-shaped antenna and at least one of the antennas is a windowpane antenna; and both of said antennas are mounted either in the front or the rear half of the vehicle.

15. The antenna installation according to claim 8, wherein said collecting network further comprises:

a plurality of switching networks, comprised of a plurality of switching elements wherein said switching networks are located within said collecting network and wherein each switching element is connected to said phase element and said amplitude evaluation element located downstream, wherein at least one of said switching networks is switched in each case to passage of a signal and the received signals switched through said network are combined in each case in an overall signal, whereby the switching networks and a antenna selector switch are synchronously switched so that a differently combined overall antenna signal is provided in each case to form an antenna diversity system.

16. The antenna installation according to claim 15, further comprising:

a plurality of antenna amplifiers each connected to said at least one electrical connection line in said collecting network, wherein said phase element and said amplitude evaluation element receive the output of said antenna amplifiers due to signal branching; and an antenna selector switch for combining signals sent from said collecting network, whereby a differently combined overall antenna signal is available in each switching position.

17. The antenna installation according to claim 16, further comprising connection gates formed at said at least one antenna connection point, said gates having a complex overall matrix defining the relationship between the electrical quantities on said connection gates wherein said collecting network is connected to said gates at said antenna connection point, whereby excitation of said gates in case of reception is detected by a substantially horizontally incident wave for all azimuthal angles based on the amount and phase relative to each other, so that the parameters for describing the electrical quantities on the connection gates are known based on the incident wave for all azimuthal angles, and the phase and amplitude contributions of the individual voltages are combined by the calculation of variations in the overall receiving signal, and the line and collecting network is designed so that the reception quality is as high as possible on the statistical average for a vehicle moving in a field of reception with statistically incident partial waves superimposed on each other.

18. The antenna installation according to claim 7, further comprising a low-resistence conductive layer disposed on said windowpane forming a two-dimensional conductive area wherein said first antenna and said at least a second antenna are formed on an edge of said conductive layer, and said coupling point is connected at high frequency to said connection point near said electrically conductive frame surrounding the windowpane.

19. The antenna installation according to claim 18, wherein the spacing between the coupling points is at least 1/10 of the wavelength, and said collecting network further comprises a phase evaluation element and an amplitude evaluation element wherein the received signals available at said at least one connection point is combined according to defined phase positions and amplitudes wherein the phase elements and amplitude evaluation elements are adjusted for a Rayleigh receiving field.

20. The antenna installation according to claim 19, wherein a windowpane antenna is mounted on a window surrounded by horizontal and substantially vertical window frame parts, wherein said at least one connection point is available both near the upper horizontal window frame part and on one side of the substantially vertical window frame parts.

21. The antenna installation according to claim 20, wherein said at least one connection point is also available near the lower horizontal window frame part.

22. The antenna installation according to claim 21, wherein said at least one connection point is available near said other substantially vertical window frame part.

* * * * *